US009829841B2

(12) United States Patent
Watanabe et al.

(10) Patent No.: US 9,829,841 B2
(45) Date of Patent: Nov. 28, 2017

(54) FIXING DEVICE AND IMAGE FORMING APPARATUS INCLUDING A FIXING DEVICE

(71) Applicant: FUJI XEROX CO., LTD., Tokyo (JP)

(72) Inventors: Shigeru Watanabe, Yokohama (JP); Jun Sawamura, Yokohama (JP); Takayuki Ukawa, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/257,133

(22) Filed: Sep. 6, 2016

(65) Prior Publication Data

US 2017/0248884 A1 Aug. 31, 2017

(30) Foreign Application Priority Data

Feb. 25, 2016 (JP) ..... 2016-034599

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2067; G03G 15/2028; G03G 15/2071; G03G 15/2032; G03G 21/1685
USPC ..... 399/328
See application file for complete search history.

(56) References Cited

U.S. PATENT DOCUMENTS 5,956,547 A * 9/1999 Kamei ..... G03G 21/1638 399/122

FOREIGN PATENT DOCUMENTS

JP 2007-024950 A 2/2007
JP 2008-032870 A 2/2008

* cited by examiner

*Primary Examiner* — Billy Lactaoen
(74) *Attorney, Agent, or Firm* — Oliff PLC

(57) ABSTRACT

A fixing device includes a first supporting member that supports one of first and a second forming members that form a nip portion by sandwiching a recording medium, a second supporting member supporting the other of the first and second forming members, a first spring pressurizing the nip portion, a cam that rotates to relatively displace the first and second supporting members in a direction in which the nip portion is released, a rotating portion disposed at a position shifted from the cam in a rotation axis direction of the cam and rotating integrally with the cam, and a second spring exerting a force on the rotating portion in a direction opposite to a rotating direction of the cam according to the rotation of the cam when a state in which the nip portion is released transitions to a state in which the nip portion is formed.

3 Claims, 9 Drawing Sheets

FIXING DEVICE AND IMAGE FORMING APPARATUS INCLUDING A FIXING DEVICE

CROSS-REFERENCE TO RELATED APPLICATIONS

This application is based on and claims priority under 35 USC 119 from Japanese Patent Application No. 2016-034599 filed on Feb. 25, 2016.

BACKGROUND

1. Technical Field

The present invention relates to a fixing device and an image forming apparatus.

2. Related Art

In the related art, a heating apparatus is proposed, which includes a fixing roller, a pressing roller, a pressing arm that supports the pressing roller, a cam that lowers the pressing arm, and an arm that supports a roller that applies drag to a peripheral surface of the cam.

SUMMARY

An aspect of the invention provides a fixing device including a first supporting member that supports one of a first forming member and a second forming member that form a nip portion by sandwiching a recording medium, a second supporting member that supports the other of the first forming member and the second forming member, a first spring that pressurizes the nip portion, a cam that rotates to relatively displace the first supporting member and the second supporting member in a direction in which the nip portion is released, a rotating portion that is disposed at a position shifted from the cam in a rotation axis direction of the cam and rotates integrally with the cam, and a second spring that exerts a force on the rotating portion in a direction opposite to a rotating direction of the cam according to the rotation of the cam when a state in which the nip portion is released transitions to a state in which the nip portion is formed.

Another aspect of the invention provides an image forming apparatus including: a developer image forming unit that forms a developer image on a recording medium; and a fixing device that fixes the developer image on the recording medium which is formed by the developer image forming unit to the recording medium. The fixing device includes: a first supporting member that supports one of a first forming member and a second forming member that form a nip portion by sandwiching a recording medium; a second supporting member that supports the other of the first forming member and the second forming member; a first spring that pressurizes the nip portion; a cam that rotates to relatively displace the first supporting member and the second supporting member in a direction in which the nip portion is released; a rotating portion that is disposed at a position shifted from the cam in a rotation axis direction of the cam and rotates integrally with the cam; and a second spring that exerts a force on the rotating portion in a direction opposite to a rotating direction of the cam according to the rotation of the cam when a state in which the nip portion is released transitions to a state in which the nip portion is formed.

BRIEF DESCRIPTION OF DRAWINGS

Exemplary embodiments of the present invention will be described in detail based on the following figures, wherein.

DETAILED DESCRIPTION

An example of a fixing device and an image forming apparatus according to an exemplary embodiment will be described.

Overall Configuration

Figure 1:
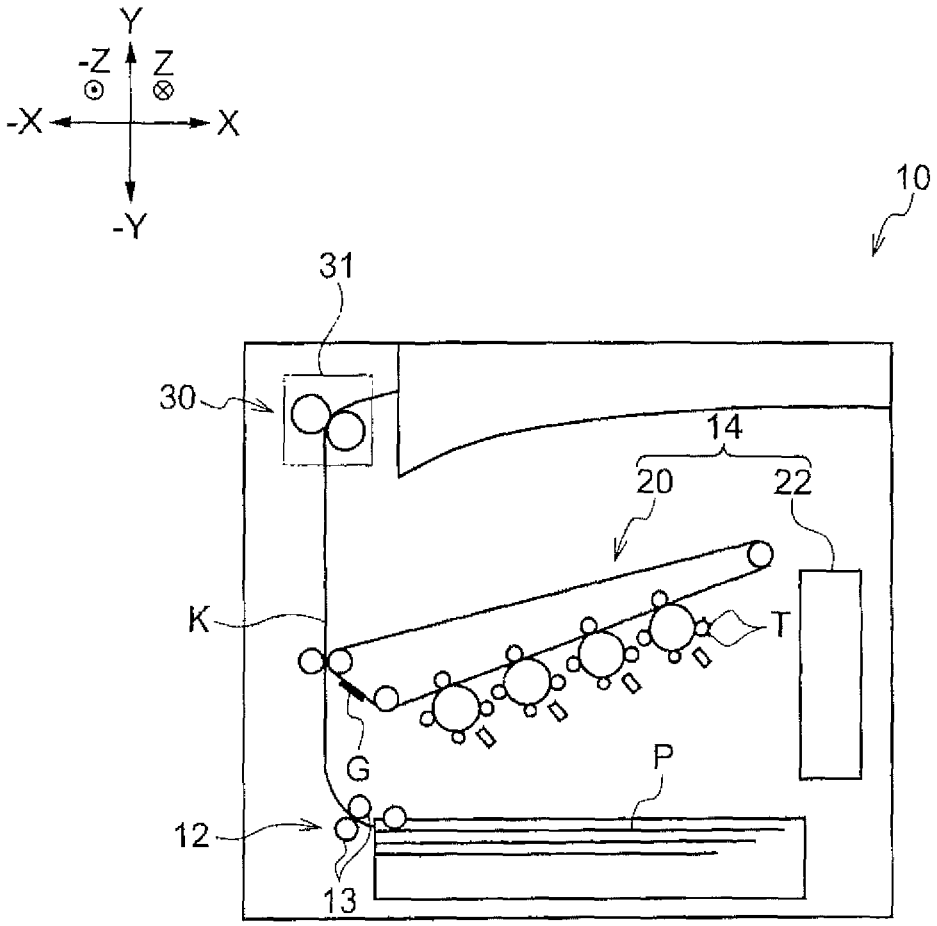
FIG. 1 is a view illustrating a configuration of an image forming apparatus according to an exemplary embodiment.

FIG. 1 is a view illustrating an image forming apparatus 10 according to an exemplary embodiment. In the following description, in FIG. 1, a direction of an arrow Y illustrates a direction of the height of the apparatus and a direction of arrow X illustrates a direction of the width of the apparatus. A direction (illustrated by Z) perpendicular to each of the direction of the height of the apparatus and the direction of the width of the apparatus illustrates a direction of the depth of the apparatus. Accordingly, the direction of the height of the apparatus, the direction of the width of the apparatus, and the direction of the depth of the apparatus are described by Y direction, X direction, and Z direction, respectively, when viewing the image forming apparatus 10 from the front surface thereof. Further, in a case where one side and the other side of each of the X direction, the Y direction, and the Z direction need to be distinguished from each other, the upper side is described as the Y side, the lower side is described as the −Y side, the right side is described as the X side, the left side is described as the −X side, the depth side is described as the Z side, and the front side is described as the −Z side, when viewing the image forming apparatus 10 from the front surface thereof.

The image forming apparatus 10 includes, as an example, a transport unit 12 that includes a pair of rolls 13 which transports paper P, an image forming unit 14 that forms a toner image G using toner T on the paper P which is transported by the transport unit 12, and a fixing device 30 that fixes the toner image G on the paper P by heating and pressurizing. A line of a reference numeral K illustrated in FIG. 1 indicates a transport path of the paper P. The paper P is an example of a recording medium. The toner T is an example of a developer. The toner image G is an example of a developer image. The image forming unit 14 is an example of a developer image forming unit.

The image forming unit 14 includes an image forming unit 20, and a controller 22 which controls an operation of each portion of the image forming unit 20 and thus allows the toner image G to be formed on the paper P. The image forming unit 20 performs, for example, an electrophotographic process, that is, a charging process, a light exposing process, a developing process, and a transfer process.

Configuration of Major Parts

Next, the fixing device 30 will be described.

Figure 2:
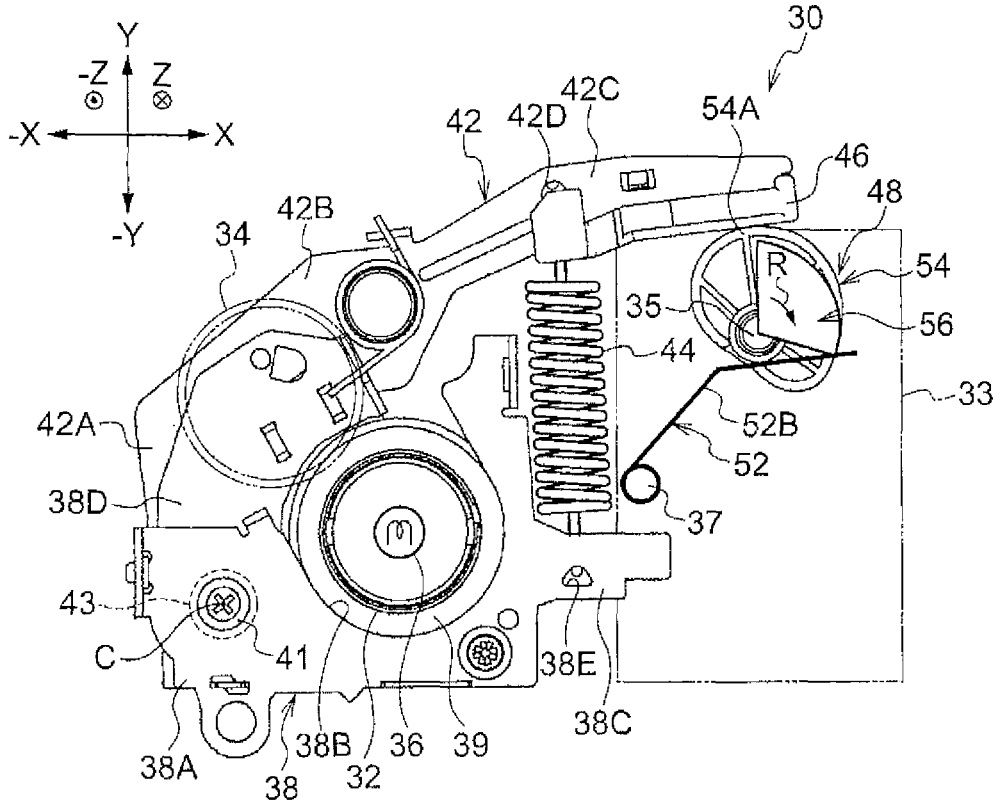
FIG. 2 is an explanatory view illustrating a nip release state in a fixing device according to the exemplary embodiment.

The fixing device 30 illustrated in FIG. 2 includes a fixing roller 32, a pressurizing belt 34, a halogen heater 36, a bracket 38, a lever member 42, a extension spring 44, a cam follower 46, a cam member 48, and a torsion spring 52. The fixing roller 32 is an example of a first forming member. The pressurizing belt 34 is an example of a second forming member. The bracket 38 is an example of a first supporting member. The lever member 42 is an example of a second supporting member. The extension spring 44 is an example of a first spring. The torsion spring 52 is an example of a second spring.

The fixing roller 32, the pressurizing belt 34, the halogen heater 36, the bracket 38, the lever member 42, the extension spring 44, the cam follower 46, the cam member 48 and the torsion spring 52 are accommodated in the inside of a casing 31 having a rectangular parallelepiped shape (see FIG. 1) which is a device main body of the fixing device 30. A pair of side walls 33 which face in the Z direction is provided in the inside of the casing 31.

Both end portions of a cylindrical shaft 35 of which an axial direction is the Z direction are provided to be rotatable by a bearing (not illustrated), in the side wall 33. The shaft 35 is rotated to be driven in the arrow R direction by a motor (not illustrated) which is controlled by the controller 22 (see FIG. 1). In addition, a cylindrical pin 37 is provided on the side wall 33 to protrude from the side wall 33. An axial direction of the cylindrical pin 37 extends along the Z direction. The pin 37 is positioned on the −Y side and the −X side of the shaft 35.

Fixing Roller

The fixing roller 32 is configured such that, as an example, an elastic body layer made of silicone rubber and a release layer made of fluororesin are formed on the outer peripheral surface of a cylindrical core metal made of aluminum. In addition, the fixing roller 32 is disposed on the toner image G side (X side) with respect to the transport path K (see FIG. 1) of the paper P and is capable of rotating about the axis by setting the Z direction as the axial direction. The halogen heater 36 is provided as a heating source in the inside of the core metal of the fixing roller 32. Further, a gear (not illustrated) is provided on the Z side of the shaft portion of the fixing roller 32. The gear is rotated by a motor (not illustrated). In this way, the fixing roller 32 is heated by the halogen heater 36 and then heats and pressurizes the paper P while rotating together with the pressurizing belt 34 to be described later and thus fixes the toner image G (the toner T) on the paper P illustrated in FIG. 1 to the paper P.

Halogen Heater

The halogen heater 36 illustrated in FIG. 2 causes heat to be generated by energization from a power source (not illustrated) and thus heats the core metal. Accordingly, the halogen heater 36 heats the entirety of the fixing roller 32. Whether or not the halogen heater 36 is energized is determined based on the result of detection of a temperature sensor (not illustrated) which detects the temperature of an outer peripheral surface of the fixing roller 32.

Pressurizing Belt

The pressurizing belt 34 is, as an example, an endless belt having a base layer made of polyimide and a release layer made of fluororesin, which is stacked on the base layer. In addition, the pressurizing belt 34 is disposed on a side opposite to the toner image G side (−X side) with respect to the transport path K (see FIG. 1) of the paper P and is capable of rotating about the axis by setting the Z direction as the axial direction. Specifically, the pressurizing belt 34 moves circularly in synchronization with the rotation of the fixing roller 32, by a pad (not illustrated) which is supported by the lever member 42 to be described later being in contact with an inner circumferential surface of the pressurizing belt 34 and pressing (pressurizing) the pressurizing belt 34 to the outer peripheral surface of the fixing roller 32. The pressurizing belt 34 is disposed on the −X side and Y side with respect to the fixing roller 32.

Figure 3:
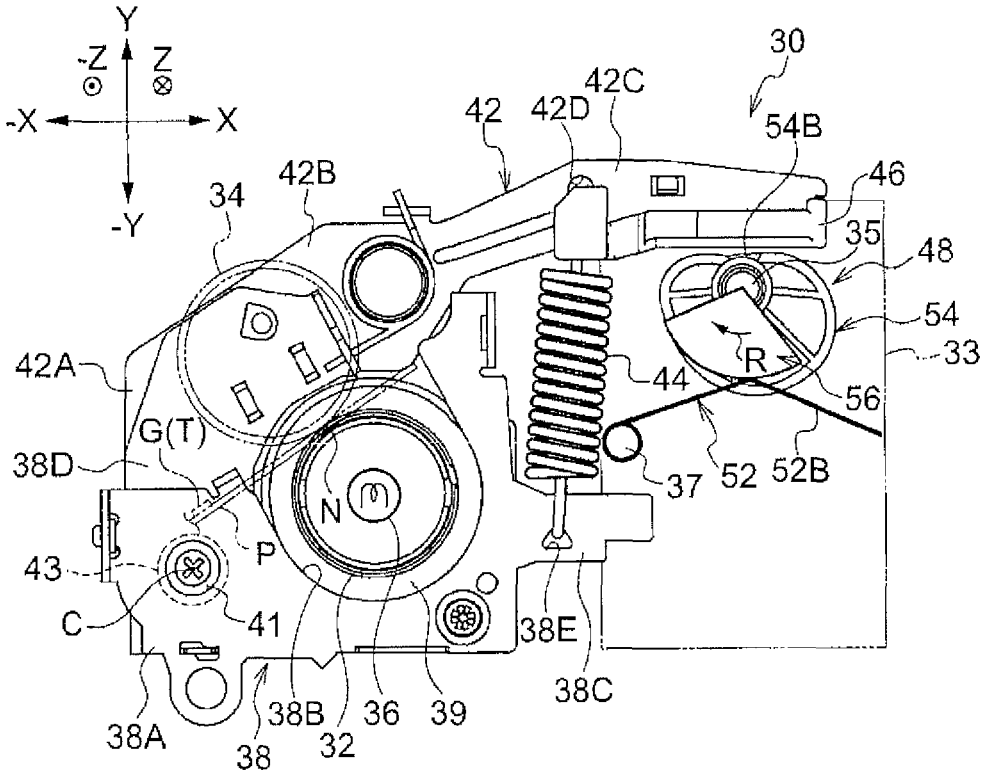
FIG. 3 is an explanatory view illustrating a nip state in the fixing device according to the exemplary embodiment.

As illustrated in FIG. 3, a region where the paper P is sandwiched between the outer peripheral surface of the fixing roller 32 and the outer peripheral surface of the pressurizing belt 34 and at which the toner T on the paper P is heated and pressurized is referred to as a nip portion N. In other words, the pressurizing belt 34 forms the nip portion N together with the fixing roller 32 by causing the paper P to be sandwiched therebetween. In a case where there is no paper P, in the nip portion N, the fixing roller 32 and the pressurizing belt 34 are in contact with each other. In the exemplary embodiment, as an example, the transport direction of the paper P in the fixing device 30 is an inclined direction in which the X side is positioned on the Y side further than the −X side. Accordingly, the nip portion N is disposed along the inclined direction. In addition, the width direction perpendicular to the transport direction of the paper P becomes the Z direction in the fixing device 30.

Bracket

A pair of brackets 38 is provided on the −X side of the side wall 33 in the inside of the casing 31 (see FIG. 1) and the brackets 38 face each other in the Z direction with the fixing roller 32 being disposed therebetween. The brackets 38 have the same configuration on the Z side and the −Z side of the fixing roller 32 and are disposed in a symmetrical manner to the center in the Z direction of the fixing roller 32. Accordingly, here, the bracket 38 of the −Z side will be described and the description of the bracket 38 of the Z side will be omitted.

In addition, the bracket 38 includes a plate shaped member which is disposed along the X-Y plane and has the Z direction as the thickness direction. Further, the bracket 38 includes a main body portion 38A having a rectangular shape, a cutout portion 38B which is formed in the main body portion 38A and is opened on the Y side, an overhanging portion 38C which is overhung on the X side from the X side end portion of the main body portion 38A along the X direction, and a longitudinal wall portion 38D which is upright on the Z side of the main body portion 38A. A bearing 39 is attached to the cutout portion 38B. The core metal of the fixing roller 32 is inserted into the bearing 39. In other words, the bracket 38 supports the fixing roller 32.

Both end portions of a shaft 43 having the Z direction as the axial direction are fixed by a screw 41 in the region on the −X side further than the cutout portion 38B in the main body portion 38A. A through hole 38E which passes through the overhanging portion 38C in the Z direction is provided in the overhanging portion 38C.

Lever Member

A pair of lever members 42 is provided in the inside of the casing 31 (see FIG. 1) and the lever members 42 face each other in the Z direction with the fixing roller 32 being disposed therebetween. The lever members 42 have the same configuration on the Z side and the −Z side of the fixing roller 32 and are disposed in a symmetrical manner to the center in the Z direction of the fixing roller 32. Accordingly, here, the lever member 42 of the −Z side will be described and the description of the lever member 42 of the Z side will be omitted.

In addition, the lever member 42 includes a plate shaped member which is disposed along the X-Y plane and has the Z direction as the thickness direction. Further, the lever member 42 includes a rectangular shape attaching portion 42A that is long in the Y direction, an inclined portion 42B which extends from the Y side end portion of the attaching portion 42A to the X side so that the X side is positioned on the Y side further than the −X side, and an extending portion 42C which extends from the X side end portion of the inclined portion 42B along the X direction. The attaching portion 42A becomes one end of the lever member 42 and the extending portion 42C becomes the other end of the lever member 42.

A bearing (not illustrated) is attached to the −Y side end portion of the attaching portion 42A. The shaft 43 is inserted into the bearing. Therefore, the attaching portion 42A is capable of rotating about the axis line of shaft 43. In other words, the lever member 42 is connected to the bracket 38 in a rotatable manner. In FIG. 3, when the lever member 42 is viewed in the Z direction, the center position of the shaft 43 and the rotation center position of the lever member 42 are illustrated by a point C. In other words, the lever member 42 is movable in an arc shape about the point C (the axis line along the Z direction), when viewed in the Z direction.

The inclined portion 42B supports both end portions of a pad (not illustrated) in the Z direction, which is in contact with the inner circumferential surface of the pressurizing belt 34. Then, the pad supports the pressurizing belt 34 so that the pressurizing belt 34 is movable in a circumferential direction. In other words, the lever member 42 supports the pressurizing belt 34.

The extending portion 42C is disposed on the Y side further than the overhanging portion 38C of the bracket 38. Moreover, the central portion of the extending portion 42C in the X direction faces the overhanging portion 38C in the Y direction. A through hole 42D which passes through the extending portion 42C in the Z direction is formed on the −X side further than the center of the extending portion 42C in the X direction. In addition, the cam follower 46 to be described later is fixed to a region on the X side and on the Y side further than the center of the extending portion 42C in the X direction. The extending portion 42C is positioned on the Y side further than the shaft 35 described above.

Cam Follower

The cam follower 46 includes, as an example, a member of which the cross section perpendicular to the longitudinal direction of the lever member 42 has a U shape. Further, the cam follower 46 is provided on the lever member 42 by being superimposed from the −Y side of the extending portion 42C on the region (lower portion) of the −Y side of the extending portion 42C and being fixed by a screw (not illustrated). Thus, the cam follower 46 constitutes a part of the lever member 42. The contact surface of the cam follower 46 in contact with the outer peripheral surface of the cam member 48 (to be described later), as an example, is a flat surface.

Extension Spring

The extension spring 44 connects the extending portion 42C of the lever member 42 and the overhanging portion 38C of the bracket 38 by one end thereof being hooked in the through hole 42D and the other end thereof being hooked in the through hole 38E, and is disposed in an elastically deformable manner in the Y direction. The extension spring 44 pressurizes the nip portion N formed by the fixing roller 32 and the pressurizing belt 34 in the rotational direction about the point C. The extension spring 44 is positioned on the −X side further than the pin 37 described above. The extension spring 44 applies an elastic force to the cam member 48 in a nip release state (which will be described later), and applies an elastic force to the nip portion N in a nip state (which will be described later).

Cam Member

As illustrated in FIG. 2, the cam member 48 includes a main body portion 54 and a rotating portion 56. The main body portion 54 is in contact with the cam follower 46 and relatively moves the bracket 38 and the lever member 42. The rotating portion 56 is disposed at a position shifted from the main body portion 54 in the Z direction and rotates integrally with the main body portion 54. The main body portion 54 is an example of the cam. The cam member 48 is disposed to have the Z direction as a rotational axis direction.

Main Body Portion

Figure 4:
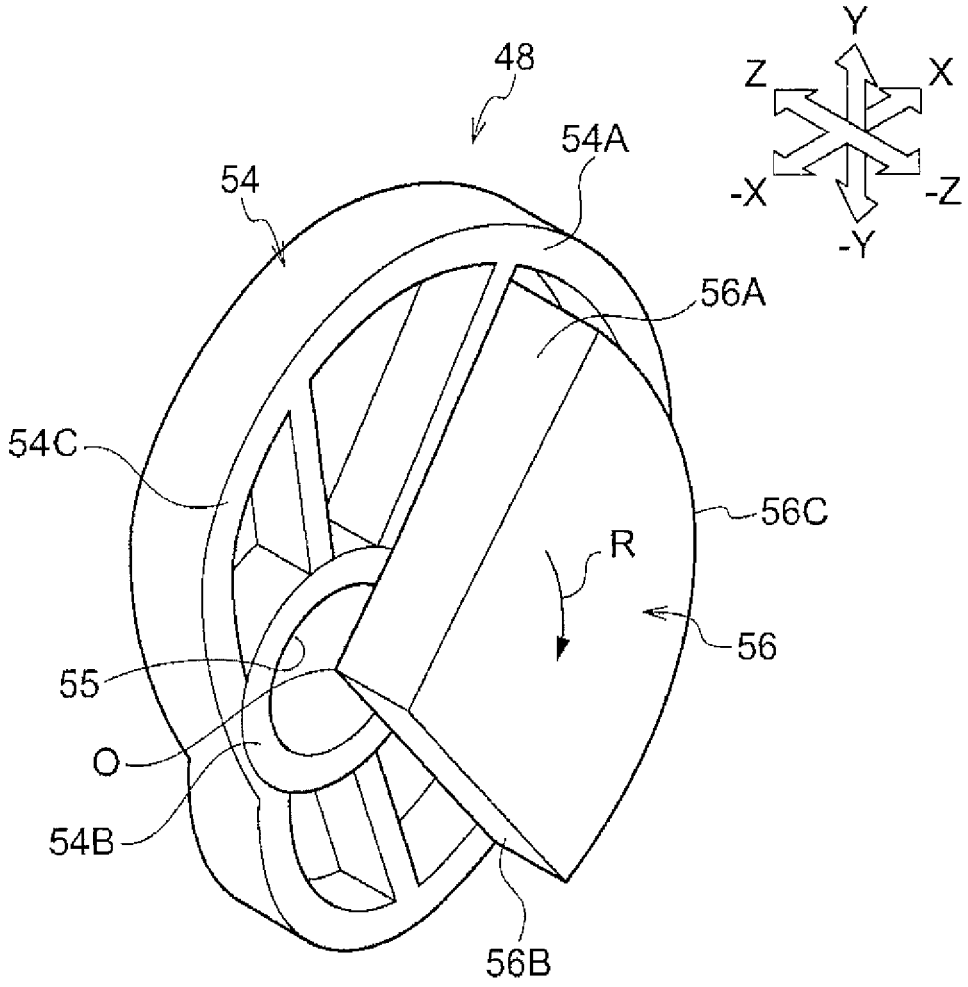
FIG. 4 is a perspective view illustrating a cam member according to the exemplary embodiment.

As illustrated in FIG. 4, the main body portion 54 is a region of which the outer peripheral surface becomes a curved surface and the Z direction is the thickness direction. Further, a circular through hole 55 passing through the main body portion 54 in the Z direction is formed in the position shifted from the center of the main body portion 54 to the outer peripheral side. The shaft 35 described above (see FIG. 2) is pressed in and fixed in the through hole 55. If the center position when the through hole 55 is viewed in the Z direction is O, the main body portion 54 includes a long-diameter portion 54A in which the distance from the center position O to the outer peripheral surface is the longest and a short-diameter portion 54B in which the distance from the center position O to the outer peripheral surface is the shortest. The short-diameter portion 54B is a region in which the main body portion 54 is recessed toward the center position O. The region except for the long-diameter portion 54A and the short-diameter portion 54B in the main body portion 54 is referred to as an intermediate-diameter portion 54C. The center position O is the rotational center position of the cam member 48.

As illustrated in FIG. 2, the main body portion 54 is in contact with the lever member 42 (the cam follower 46), rotates in the R direction (in the clockwise direction when viewed from the −Z side to the Z side), and relatively moves the bracket 38 and the lever member 42 in a direction in which the nip portion N is released. The nip portion N is released and then the main body portion 54 is further rotated in the R direction and thus the nip state where the nip portion N is formed is obtained.

Rotating Portion

Figure 5:
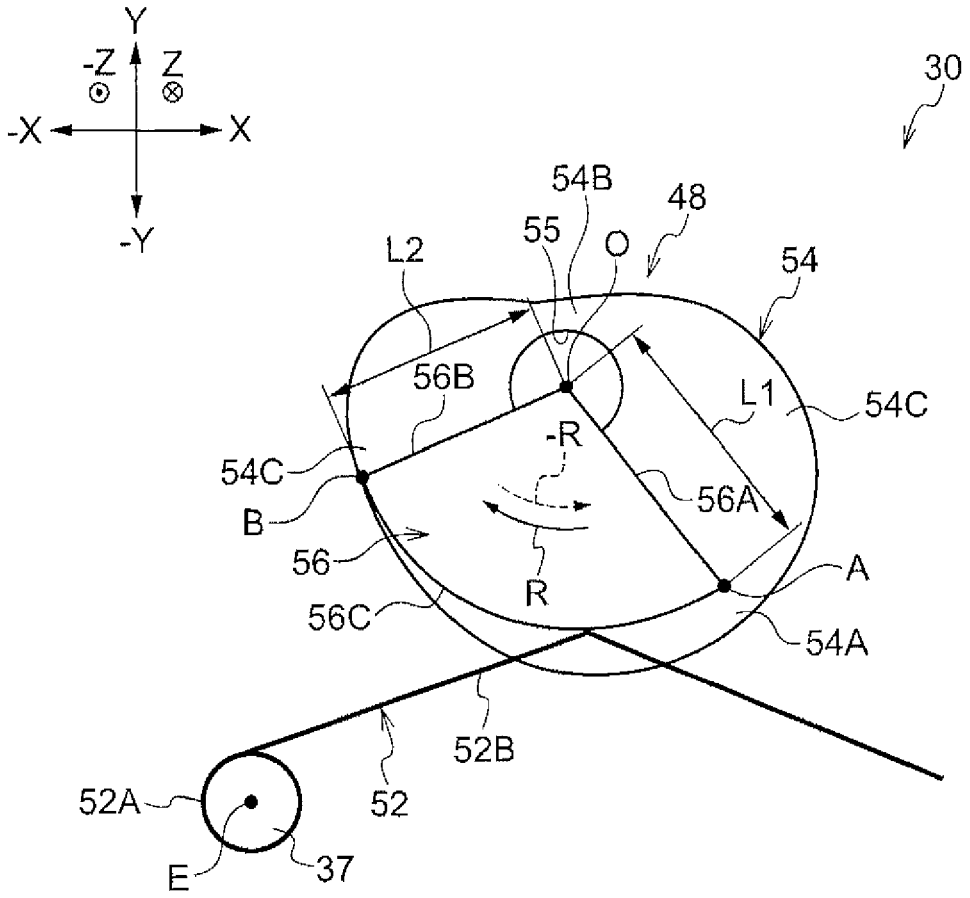
FIG. 5 is an explanatory view schematically illustrating arrangement of a cam member and a torsion spring according to the exemplary embodiment.

As shown in FIG. 5, the rotating portion 56 is formed in a fan shape in which the central angle is an obtuse angle when viewed in the Z direction. Specifically, as illustrated in FIG. 4, the rotating portion 56 is a plate shaped region in which the Z direction is the thickness direction. The rotating portion 56 includes a first peripheral surface 56A and a second peripheral surface 56B which are two flat surfaces forming a central angle of a fan shape, and a third peripheral surface 56C which is a curved surface which connects the end portion of the first peripheral surface 56A and the end portion of the second peripheral surface 56B and outwardly projects and is an arc-shaped curved surface when viewed in the Z direction. The first peripheral surface 56A is positioned on the upstream side in the R direction, and the second peripheral surface 56B is positioned on the downstream side in the R direction.

As shown in FIG. 5, when the cam member 48 is viewed in the Z direction, the position of the boundary between the first peripheral surface 56A and the second peripheral surface 56B overlaps the center position O described above. The first peripheral surface 56A extends toward the long-diameter portion 54A when viewed in the Z direction. The second peripheral surface 56B extends toward the intermediate-diameter portion 54C on the downstream side of the long-diameter portion 54A in the R direction and on the upstream side of the short-diameter portion 54B, when viewed in the Z direction. Here, a length of a line segment OA which connects the upstream end (point A) in the R direction of the third peripheral surface 56C and a center position O is referred to as L1. In addition, a length of a line segment OB which connects the downstream end (point B) in the R direction of the third peripheral surface 56C and a center position O is referred to as L2. In the exemplary embodiment, as an example, the length L1 is longer than the length L2. The third peripheral surface 56C is formed so that the length of a line segment connecting the center position O and the third peripheral surface 56C becomes short in succession from the length L1 to the length L2 toward the R direction.

If the central axis of the pin 37 is referred to as E, the center position O of the cam member 48 is positioned on the X side and the Y side (upwardly inclined) with respect to the central axis E of the pin 37.

Here, as shown in FIG. 3, in a state where the fixing roller 32 and the pressurizing belt 34 form the nip portion N, the elastic force by the extension spring 44 act on the nip portion N. However, since the fixing roller 32 serves as a stopper, the lever member 42 is held in a state of having a gap in the Y direction between the lever member 42 and the cam member 48 in a state in which the short-diameter portion 54B is directed to the Y-side. However, in a case where the cam member 48 stops at a rotational position shifted from the set position in the R direction, there is a possibility of contact between the cam member 48 and the lever member 42 (the cam follower 46).

Torsion Spring

As shown in FIG. 5, the torsion spring 52 includes an annular winding unit 52A in which the pin 37 is inserted and which is elastically deformed, and an arm portion 52B which extends from the winding unit 52A in a bar shape. The arm portion 52B is disposed so that the position in the Z direction is the same position as the rotating portion 56. Further, the arm portion 52B is disposed so that the central portion is bent to project toward the rotating portion 56 and thus is in contact with the rotating portion 56. In FIG. 5, a state where the arm portion 52B is in contact with the third peripheral surface 56C is schematically illustrated.

When a state in which the nip portion N is released (see FIG. 2) transitions to a state in which the nip portion N is formed, the torsion spring 52 applies a braking force (drag force) to the rotating portion 56. Specifically, the torsion spring 52 applies a force to the rotating portion 56 such that a force (moment) in the direction (−R direction) opposite to the R direction acting on the rotating portion 56 and the frictional force acting on the rotating portion 56 increase according to the rotation of the main body portion 54 in the R direction. In other words, the direction and magnitude of the moment acting on the cam member 48 are changed in the fixing device 30, according to the rotation of the cam member 48 in the R direction.

Here, as shown in FIG. 3, a state where the short-diameter portion 54B of the cam member 48 faces the cam follower 46 toward the Y side and the pressurizing belt 34 is pressed into the fixing roller 32 side and thus the nip portion N is formed is referred to as the nip state. Further, as shown in FIG. 2, a state where the long-diameter portion 54A of the cam member 48 and the cam follower 46 are in contact with each other and the pressurizing belt 34 is not in contact with the fixing roller 32 is referred to as the nip release state. In the nip release state, the arm portion 52B of the torsion spring 52 is not elastically deformed. Therefore, even if the torsion spring 52 and the rotating portion 56 are in contact with each other, a braking force (drag force) is not applied to the rotating portion 56.

Next, an advantages of the exemplary embodiment will be described.

Figure 6A:
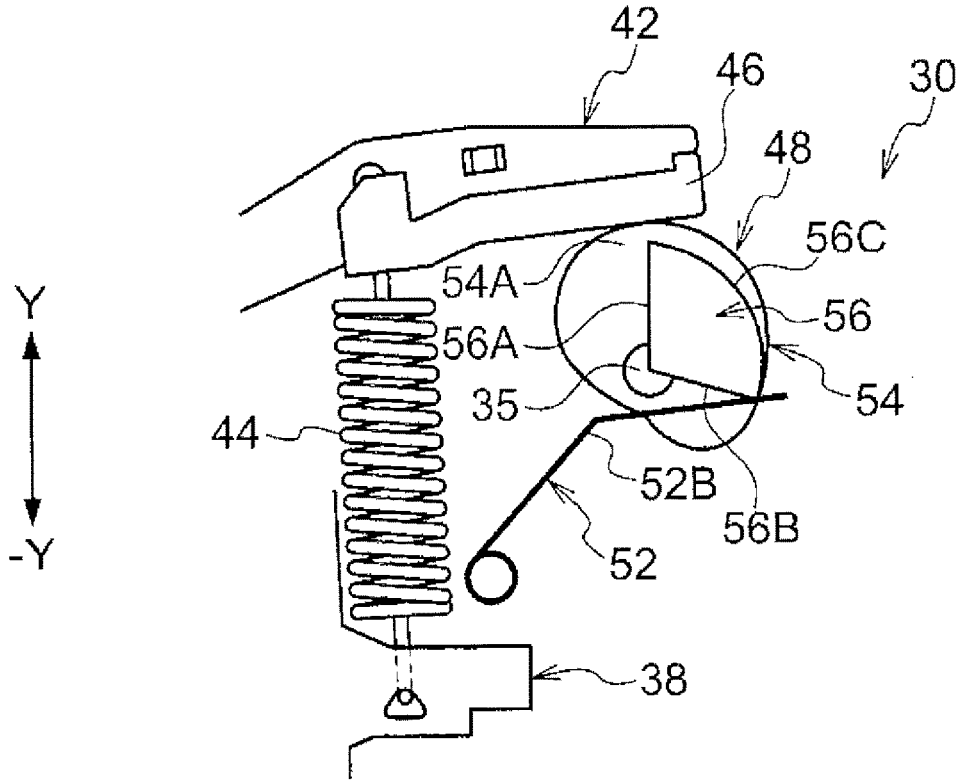
FIGS. 6A to 6C are explanatory views illustrating a state of the cam member and each member about the cam member when a state in which the nip portion is released transitions to a state in which the nip portion is formed in the fixing device according to the exemplary embodiment.

As shown in FIG. 2, the fixing roller 32 and the pressurizing belt 34 are in the nip release state in the fixing device 30. Here, as shown in FIG. 6A, in the state where the long-diameter portion 54A of the cam member 48 and the cam follower 46 are in contact with each other, as described above, the arm portion 52B of the torsion spring 52 is not elastically deformed. Therefore, the braking force is not applied to the rotating portion 56. A state where the long-diameter portion 54A of the cam member 48 and the cam follower 46 are in contact with each other is a state where the torsion spring 52 and the end portion of the second peripheral surface 56B of the rotating portion 56 are in contact with each other.

Figure 6B:
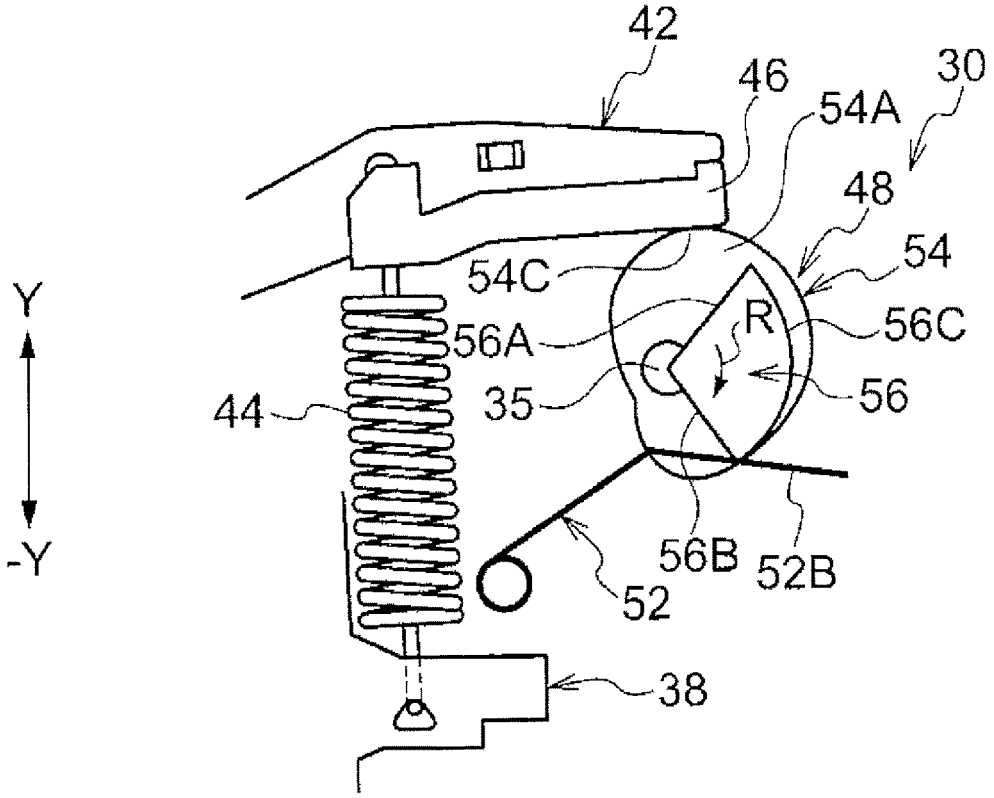

As shown in FIG. 6B, in a state where the cam member 48 rotates in the R direction and then the intermediate-diameter portion 54C and the cam follower 46 are in contact with each other, the pressurizing belt 34 (see FIG. 2) approaches the fixing roller 32 (see FIG. 2), compared with a state where the long-diameter portion 54A of the cam member 48 and the cam follower 46 are in contact with each other. At this time, the arm portion 52B of the torsion spring 52 is deformed on the −Y side and applies a braking force (moment in the direction opposite to the R direction) to the rotating portion 56.

Figure 6C:
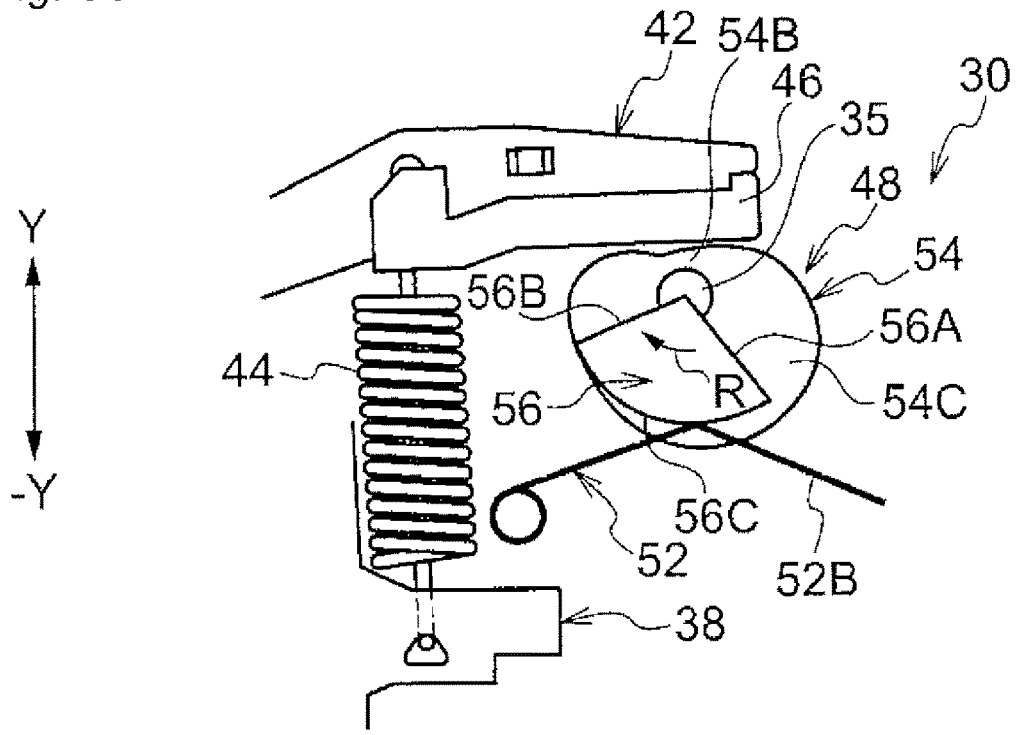

As shown in FIG. 6C, in a state where the cam member 48 rotates in the R direction and then the short-diameter portion 54B and the cam follower 46 most closely approach each other, the pressurizing belt 34 (see FIG. 2) approaches the fixing roller 32 (see FIG. 2), compared with a state where the intermediate-diameter portion 54C of the cam member 48 and the cam follower 46 are in contact with each other. Then, the nip portion N (see FIG. 2) is formed by the pressurizing belt 34 and the fixing roller 32. At this time, the arm portion 52B of the torsion spring 52 is in contact with the side close to the first peripheral surface 56A, of the third peripheral surface 56C. Therefore, a large amount of braking force (the moment and the frictional force in the direction opposite to the R direction) is applied to the rotating portion 56, compared with a state where the arm portion 52B is in contact with the side close to the second peripheral surface 56B. Therefore, the cam member 48 is prevented from being excessively rotated, compared with the configuration in which there is no the torsion spring 52.

Here, in the cam member 48, the torsion spring 52 is not in contact with the outer peripheral surface of the main body portion 54 and is in contact with the rotating portion 56 shifted from the main body portion 54 in the Z direction. In other words, the first peripheral surface 56A, the second peripheral surface 56B and the third peripheral surface 56C of the rotating portion 56 are not in contact with the cam follower 46, unlike the outer peripheral surface of the main body portion 54. Therefore, since the surface shape becomes freely set without restriction of the shape of the cam member 48, the braking force to be applied to the cam member 48 is likely to be optimized and the cam member 48 is likely to be braked in the rotating portion 56, compared with the configuration in which the braking force is applied to the outer peripheral surface of the main body portion 54. Thus, when the cam member 48 is rotated to enter the nip state, the positional deviation of the cam member 48 in the R direction is suppressed and the cam member 48 and the cam follower 46 are likely to be separated. Thus, the noise caused by the cam member 48 and the cam follower 46 being in contact with each other is reduced.

As illustrated in FIG. 5, the third peripheral surface 56C of the cam member 48 is formed so that the length of the line segment connecting the center position O and the third peripheral surface 56C having an arc shape becomes short in succession from the length L1 to the length L2 toward the R direction. In other words, the third peripheral surface 56C is formed so that the length of the line segment connecting the center position O and the third peripheral surface 56C becomes long in succession from the length L2 to the length L1 toward the −R direction. Thus, in the fixing device 30, since the force acting on the rotating portion 56 is gradually increased, sudden fluctuations in braking force acting on the cam member 48 according to the rotation in the R direction are unlikely to occur, compared with the configuration in which the shape of the rotating portion 56 is a circular arc about the rotational center, when viewed in the Z direction.

In the image forming apparatus 10 (see FIG. 1), generation of the noise caused by the cam follower 46 and the cam member 48 being in contact with each other in the fixing device 30 illustrated in FIG. 3 is suppressed. Therefore, compared with the configuration without the fixing device 30, generation of the noise in the image forming apparatus 10 in a nip release state associated with jamming (clogging) elimination of the paper P is suppressed.

Figure 7:
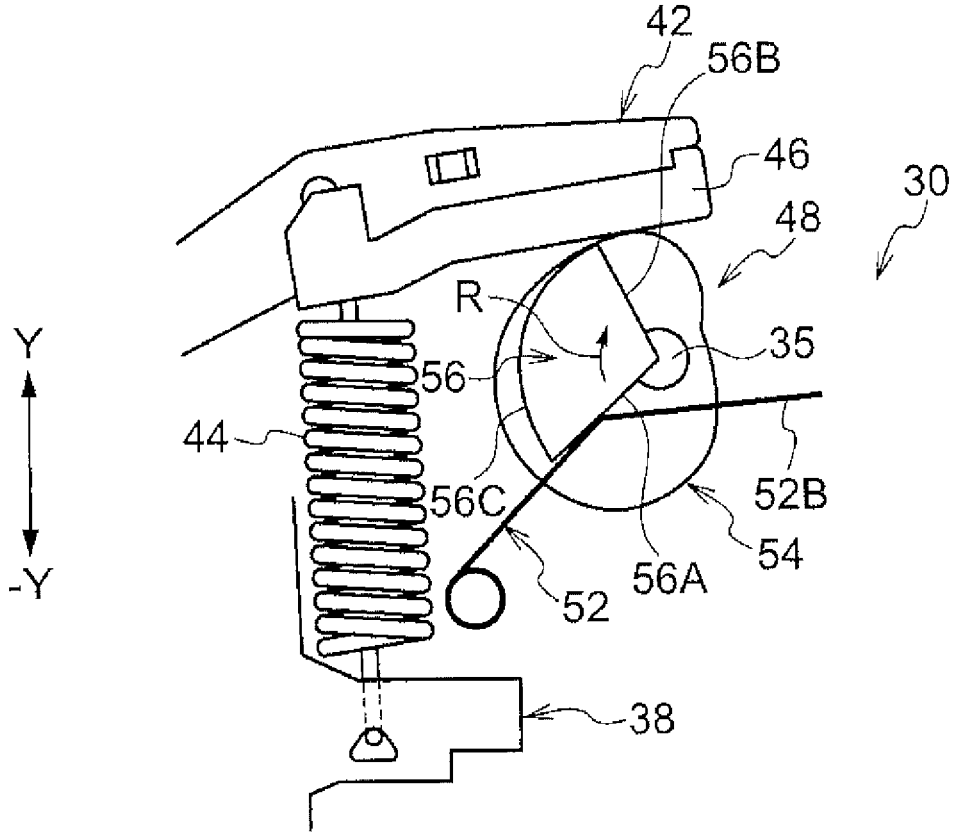
FIG. 7 is an explanatory view illustrating a state of the cam member and each member about the cam member when a state in which the nip portion is formed transitions to a state in which the nip portion is released in the fixing device according to the exemplary embodiment.

As shown in FIG. 7, when the cam member 48 continues to rotate in the R direction from the nip state, the contact position between the torsion spring 52 and the rotating portion 56 transitions from the third peripheral surface 56C to the first peripheral surface 56A. Then, the cam member 48 begins to push up the lever member 42 on the Y side. In this case, the elastic force of the torsion spring 52 acts on the cam member 48 so as to rotate the cam member 48 in the R direction. Thus, for example, even if the shaft 35 is difficult to rotate, since the cam member 48 rotates by receiving an elastic force in the R direction, the nip release state occurs in the fixing device 30.

The exemplary embodiment of the invention is not limited to the exemplary embodiment described above.

The lever member 42 is fixed to the inside of the casing 31 and the cam follower 46 may be provided to the bracket 38 such that the bracket 38 is rotatable, and thus. In this configuration, the bracket 38 and the cam follower 46 may be integrated with each other. Further, the cam follower 46 is not limited to be provided separately from the lever member 42 and may be integrated with the lever member 42. Further, the bracket 38 and the lever member 42 are not limited to the configuration in which the bracket 38 and the lever member 42 are connected by the shaft 43, and the bracket 38 and the lever member 42 may be configured to be movable independently.

The first forming member is not limited to the fixing roller 32 and may be a fixing belt. The second forming member is not limited to the pressurizing belt 34 and may be a pressurizing roll. Further, the first forming member may be the pressurizing belt 34 or the pressurizing roll and the second forming member may be the fixing roller 32 or the fixing belt.

The first spring is not limited to one connecting the bracket 38 and the lever member 42, and may separately pressurize the bracket 38 and the lever member 42. The second spring is not limited to the torsion spring 52 and may be a bent leaf spring.

The length L1 of the line segment OA and the length L2 of the line segment OB may be the same as each other in the rotating portion 56. The shape of the rotating portion 56 may be a circular arc shape about the rotational center when viewed in the Z direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first supporting member that supports one of a first forming member and a second forming member that form a nip portion by sandwiching a recording medium;

a second supporting member that supports the other of the first forming member and the second forming member;

a first spring that pressurizes the nip portion;

a cam that rotates to relatively displace the first supporting member and the second supporting member in a direction in which the nip portion is released;

a rotating portion that is disposed at a position shifted from the cam in a rotation axis direction of the cam and rotates integrally with the cam; and a second spring that exerts a force on the rotating portion in a direction opposite to a rotating direction of the cam according to the rotation of the cam when a state in which the nip portion is released transitions to a state in which the nip portion is formed.

2. The fixing device according to claim 1, wherein the rotating portion is formed in a fan shape when viewed in the rotation axis direction, and wherein a line segment connecting an upstream end of an arc of the rotating portion in the rotation direction and a rotational center of the rotating portion is longer than a line segment connecting a downstream end of the arc in the direction and the rotational center.

3. An image forming apparatus comprising:

a developer image forming unit that forms a developer image on a recording medium; and a fixing device that fixes the developer image on the recording medium which is formed by the developer image forming unit to the recording medium, the fixing device including:

a first supporting member that supports one of a first forming member and a second forming member that form a nip portion by sandwiching a recording medium;

a second supporting member that supports the other of the first forming member and the second forming member;

a first spring that pressurizes the nip portion;

a cam that rotates to relatively displace the first supporting member and the second supporting member in a direction in which the nip portion is released;

a rotating portion that is disposed at a position shifted from the cam in a rotation axis direction of the cam and rotates integrally with the cam; and a second spring that exerts a force on the rotating portion in a direction opposite to a rotating direction of the cam according to the rotation of the cam when a state in which the nip portion is released transitions to a state in which the nip portion is formed.

* * * * *